United States Patent [19]

Martinez

[11] 4,330,964

[45] May 25, 1982

[54] SANDING DEVICE

[76] Inventor: Evidio Martinez, 6875 Tamiami Canal Rd., Miami, Fla. 33126

[21] Appl. No.: 139,745

[22] Filed: Apr. 14, 1980

[51] Int. Cl.[3] ..... B24B 23/00

[52] U.S. Cl. ..... 51/170 MT; 51/387

[58] Field of Search ..... 51/170 MT, 170 TL, 170 R, 51/358, 382, 383, 384, 385, 386, 387, 393, 391

[56] References Cited

U.S. PATENT DOCUMENTS 3,488,897 1/1970 Taafe, Jr. ..... 51/387

3,546,822 12/1970 Hutchins ..... 51/387

*Primary Examiner*—Roscoe V. Parker

*Attorney, Agent, or Firm*—John Cyril Malloy

[57] ABSTRACT

A sander with an improved adapter having spring-loaded clips for releasably locking the sander to the adapter and a second pair of clips for overlaying a piece of sandpaper over the lower surface of the adapter for releasable engagement thereto.

1 Claim, 3 Drawing Figures

SANDING DEVICE

BACKGROUND OF THE INVENTION

Technical Field of the Invention

This invention relates to hand-held tools and more particularly to hand-held sanding tools.

There have been many hand-held tools and many hand-held sanding tools which are capable of mechanically sanding an area. However, there has always been an outstanding problem in attaching easily and efficiently sandpaper and the like grinding surface to the hand-held tool.

Applicant has deviced a device wherein the sandpaper may be clipped to an adapter having a pad and means for connection to a conventional sanding tool with great ease and efficiency.

Summary of the Invention

A hand-held mechanical sanding tool comprising a conventional sanding tool, an adapter and a grinding surface. The conventional hand-held sanding tool including clip means for positively locking the adapter to it. The adapter including means for compatible interconnection with the sander spaced inwardly from the adapter, releasable clip means for adapting and releasably locking an elongate piece of sandpaper to the bottom surface of the adapter and a pad interposed between the adapter and the sandpaper with the sandpaper sized and shaped for compatible interconnection with the clip means and the pad.

In accordance with these and other objects which will become apparent hereinafter, the instant invention will now be described with reference to the accompanying drawings in which:

DESCRIPTION OF THE PREFERRED EMBODIMENT

Figure 1:
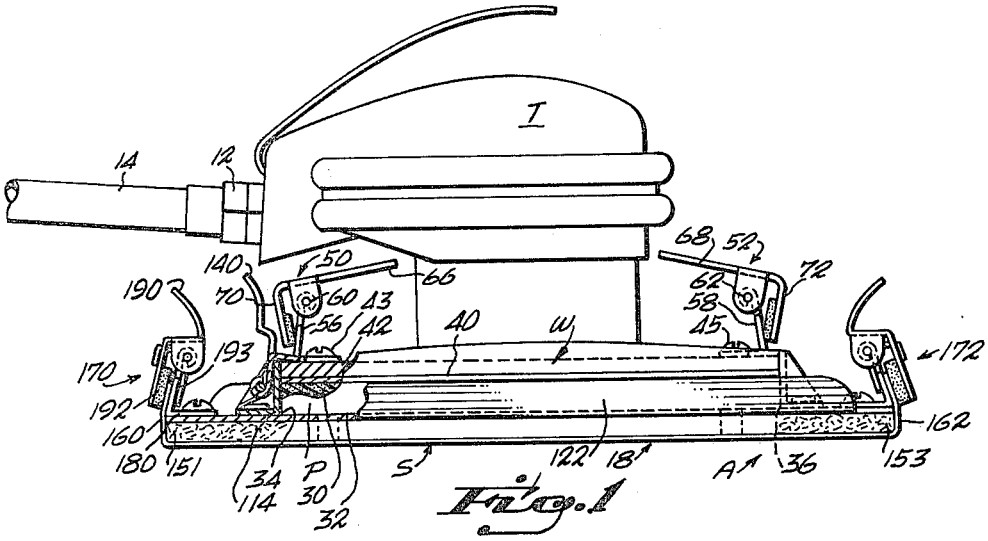
FIG. 1 is a side elevation view which has been partly broken away and which illustrates the sander tool in combination with the instant adapter mounted to the lower surface thereof and carrying a piece of sandpaper.
Figure 2:
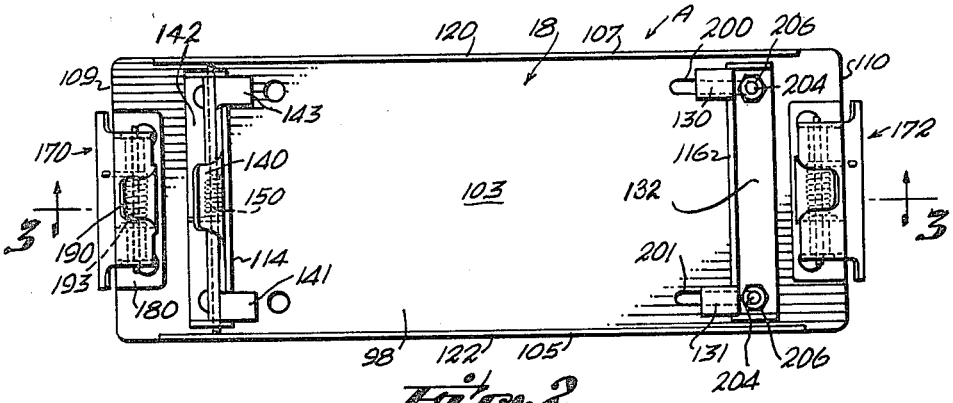
FIG. 2 is a top plan view of the adapter of the instant invention.
Figure 3:
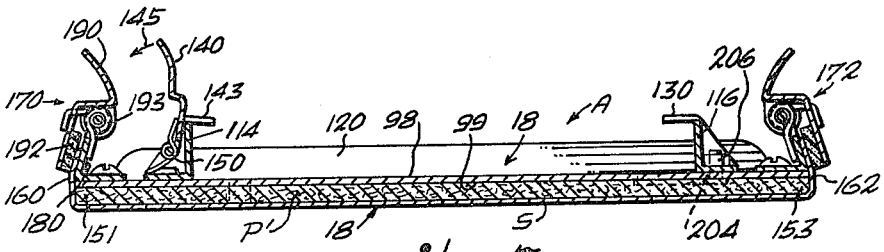
FIG. 3 is a side view in cross section taken on the plane indicated by the line 3—3 of FIG. 2 and looking in the direction of the arrows.

Referring to the drawings wherein like reference characters designate like or corresponding parts throughout the several views, the combination is shown which is composed generally of (a) the sander tool designated by the letter T which has a fitting 12 adapted to be connected to a compressed air line 14 and (b) the adapter, shown in FIGS. 2 and 3 and indicated by the arrowed line A in those Figures as well as in FIG. 1. The adapter includes a tray generally designated by the arrowed line 18 which is sized to fit beneath and to nest the working portion of the tool generally designated by the letter W. An elongate piece of sandpaper generally designated by the letter S releasably covers the bottom of the tray.

Referring particularly to the tool T and more particularly to the lower or working end W, it includes a pad P which is conventionally of rubbery material as indicated by the numeral 30 and is adhered to a plate 40.

The pad has a lower surface 32 with a first end edge 34 and an opposite second end edge 36. The plate 40 is affixed to a bottom structure 42 of the tool working portion W by screws such as 43 and 45. As is conventional, these screws secure clip means each of which is generally designated by the numerals 50 and 52 and each of which is adpated to engage one of the ends of a piece of sandpaper stretched across the pad P. Each of the clip means 50 and 52 includes an upstanding member, 56 and 58, at the upper terminal end of which there is a pivot means such as 60 and 62 for pivotal movement of spring-loaded clamp arms 66 and 68 each having a swingable portion such as 70 and 72, which are padded, to be moved into and out of clamping engagement of the ends of a piece of sandpaper which overlays the bottom of the pad P in conventional use.

Referring now to the adapter A shown in FIG. 2 and 3, it is composed of a tray generaly designated by the number 18 which includes a floor 103 having an upper and lower surface 98 and 99 respectively and side edges 105 and 107 with a first end 109 and a second end 110. The end edges 109 and 110 are spaced from one another a distance greater than the distance between the ends 34 and 36 of the lower working surface of the tool T. In upstanding relation along the inside surface of the tray there is a side wall 120 and 122 which are in spaced relation from one another. On the tray and spaced inwardly from tray end 109 there is a first seat wall 114 and spaced inwardly from tray end 110 there is a second seat wall 116. The walls are spaced from one another a distance which is sufficient to receive and nest about the working end of the tool, thus defining a seat.

Releasable tool clip means 132 and 142 for the main planar surface are provided as shown in FIGS. 2 and 3 to captivate the tool in the seat of the adapter. In the preferred embodiment illustrated, the second clip means 132 is composed of a first pair of spaced and fixed ears 130 and 131 which extend inwardly from the top ends of the second seat wall 116 defining ears. These ears are of a height so that the ears overlay the upper surface of the working end W of the tool. With particular reference to FIG. 3 there is seen adjacent the first seat wall 114, a swingable and releasable first tool clip means 142 for the main planar surface which is comprised of: (a) a second pair of spaced and fixed ears 141 and 143 which extend inwardly from the top ends of the seat wall 114 defining ears, and, (b), an upstanding portion 140 which is spring-urged by the spring means 150 to the normal position shown in FIG. 3 in which the ears 141 and 413 are adapted to captivate the working portion of the tool, as in the case of the ear 143 shown in FIG. 3, when the working portion of the tool is seated onto the adapter A. The ears are swingable in the direction of the arrowed line 145 to tilt into an out-of-the-way position for inserting or removing the tool from the adapter A.

Referring further to the adapter A, the lower surface of the floor 103 is covered with a pad P' having a first end edge 151 and a second end edge 153 which, in use is covered by an elongated piece of sandpaper previously designated by the numeral S with its end marginal portions indicated by the numerals 160 and 162 being upturned are held to the adapter by releasable sandpaper clip means designated by the numerals 170 and 172, one of which will now be described.

Referring to the releasable sandpaper clip means 170 which includes an upstanding portion 180 fixed to the adapter A between the end edge 109 and the upstanding first seat wall 114. The clip 170 further includes a swingable arm 190 with a pad 192 normally clampingly engaging the fixed portion 180 to clamp the margin of the sandpaper. It is spring-urged into the position shown by the spring means 193. Similar structure is provided at the opposite end for the clip designated by the numeral 172.

The adapter may also include means for allowing the second seat wall to move to and fro comprising slots 200 and 201 extending laterally in the floor 103 and spaced from side edge 107 and 105 respectively. The second side wall 116 includes means for locking the wall in position and may be as shown in FIG. 2 comprised of a bolt 204 shown in FIG. 3, and a nut 206 shown in FIG. 2 in each recess. Thereby the nut may be tightened with the side wall is correctly positioned.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. In combination, a hand-held orbital sanding tool having a working portion with a main planar generally rectangular working surface including a leading edge, trailing edge, and a pair of side edges, an elongated generally rectangular sandpaper strip having parallel side edges, and an adapter, said adapter comprising (a) a generally rectangular tray having a floor portion with an upper and lower surface, first and second end edges and a pair of side edges, each having upstanding side walls and first and second upstanding walls spaced from said first and second end edges, respectively, thereby the walls defining a seat sized to mate compatibly with said rectangular sanding tool working surface portion in confronting relation to said floor, (b) a first and second releasable tool clip means for engaging said main planar surface, and (c) a first and second releasable sandpaper clip means, said first sandpaper clip means being fixed on said floor adjacent said first end edge between said first wall and said first end edge, said second sandpaper clip means fixed on said floor adjacent said second end edge between said second wall and said second end edge for releasable engagement of said sandpaper strip in covering relation to said adapter, said first tool clip means comprising an upstanding member with a spring means having a terminal end with a pivot means for pivotal movement of a pair of spaced apart spring-loaded clamp arms, each clamp arm having a swingable portion movable into and out of clamping engagement with said working portion of said tool, said first and second sandpaper clip means each comprising (a) an upstanding portion fixed to said floor, (b) a swingable arm with an upper, lower, and middle section such that said middle section connects to said fixed upstanding portion on a swivel and spring means, said lower section is forced to overlap said fixed upstanding portion and has padding fixed to an interface area where said spring means urges the clip in a captivating relation with respect to said sandpaper at said interface area, and said upper section is upstanding and curves away from said tray such that pressure applied in the direction of the seat will separate said lower section from said fixed upstanding portion and allow said sandpaper adjustment, said floor lower surface having a pad, said second cool clip means comprising (a) a pair of spaced and fixed ears which extend toward said seat from said second side wall at a height such that ears overlay said working surface of said sanding tool, and (b) a bolt and nut securing means to secure said second tool clip means to said floor where said floor has a pair of slots adjacent and spaced from said side wall and a predetermined distance from said second end edge, and wherein said second tool clip means has an aperture aligned with each slot and securing means for placement on said floor, thereby said second side wall may slide between said end edges creating an adjustable means for adapting said seat to various sized tool working surfaces, said sandpaper clip means being adapted to releasably and clampingly engage the ends of the piece of sandpaper and hold the piece in covering relation to the pad on the lower surface of said floor member.

* * * * *